US005355627A

United States Patent [19]

Katz

[11] Patent Number: 5,355,627

[45] Date of Patent: Oct. 18, 1994

[54] CABINET HAVING AN INTERNAL POWER SUPPLY AND A DOOR CASING GASKET

[75] Inventor: Howard S. Katz, Riegelsville, Pa.

[73] Assignee: Robern, Inc., Bensalem, Pa.

[21] Appl. No.: 144,588

[22] Filed: Oct. 28, 1993

Related U.S. Application Data

[60] Continuation of Ser. No. 889,658, May 27, 1992, abandoned, Division of Ser. No. 587,701, Sep. 25, 1990, abandoned.

[51] Int. Cl.[5] ..... E06B 7/16

[52] U.S. Cl. ..... 49/479.1; 49/402; 312/227

[58] Field of Search ..... 49/479.1, 483.1, 490.1, 49/402; 312/296, 227, 326

[56] References Cited

U.S. PATENT DOCUMENTS

| | | | |
|---|---|---|---|
| 1,465,292 | 8/1923 | Wessig . | |
| 1,993,173 | 3/1935 | Kuyper | 156/17 |
| 2,015,816 | 10/1935 | Pyzel, 4th | 219/19 |
| 2,103,384 | 12/1937 | Somohano | 88/73 |
| 2,564,836 | 8/1951 | Elsenheimer | 219/19 |
| 2,617,701 | 11/1952 | Fennell | 312/227 |
| 2,815,433 | 12/1957 | Zumwalt | 219/45 |
| 3,160,736 | 12/1964 | Catterson | 219/219 |
| 3,327,429 | 6/1967 | Slaughter | 49/485 |
| 3,371,445 | 3/1968 | Herr | 49/485 |
| 3,461,517 | 8/1969 | Eisenhart | 49/485 |
| 3,530,275 | 9/1970 | Rust | 219/219 |
| 3,584,977 | 6/1971 | Coleman | 417/53 |
| 3,597,586 | 8/1971 | Rebovich | 219/219 |
| 3,732,702 | 5/1973 | Desch | 62/3 |
| 3,839,620 | 10/1974 | Seibel et al. | 219/219 |
| 3,887,788 | 6/1975 | Seibel et al. | 219/219 |
| 4,037,079 | 7/1977 | Armbruster | 219/219 |
| 4,060,712 | 11/1977 | Chang | 219/219 |
| 4,195,416 | 4/1980 | Hall | 34/90 |
| 4,665,304 | 5/1987 | Spencer | 219/219 |
| 4,701,594 | 10/1987 | Powell | 219/219 |
| 4,927,215 | 5/1990 | Katz | 312/224 |

FOREIGN PATENT DOCUMENTS

| | | | |
|---|---|---|---|
| 1065980 | 6/1954 | France | 49/495 |

*Primary Examiner*—Kenneth J. Dorner
*Assistant Examiner*—Gerald A. Anderson
*Attorney, Agent, or Firm*—Panitch Schwarze Jacobs & Nadel

[57] ABSTRACT

A cabinet includes a cabinet body having an internal storage area for receiving items to be stored and a door casing which defines an opening for accessing the storage area. The cabinet door is pivotally mounted to the cabinet body and includes an interior surface and an exterior surface. The cabinet door pivots with respect to the cabinet body between an open and closed position. A gasket is positioned on the door casing such that the gasket substantially covers the door casing. As such, the interior surface of the cabinet door is in engagement with the gasket when the cabinet door is in the closed position.

3 Claims, 3 Drawing Sheets

FIG. 4
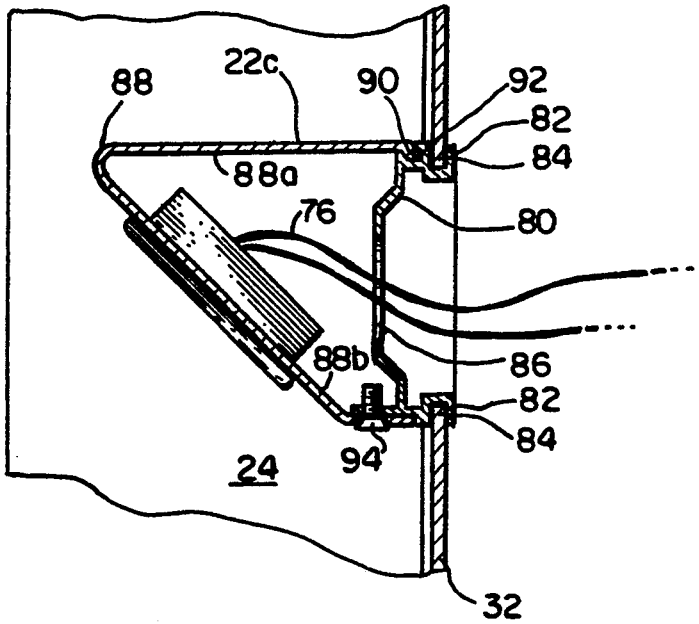
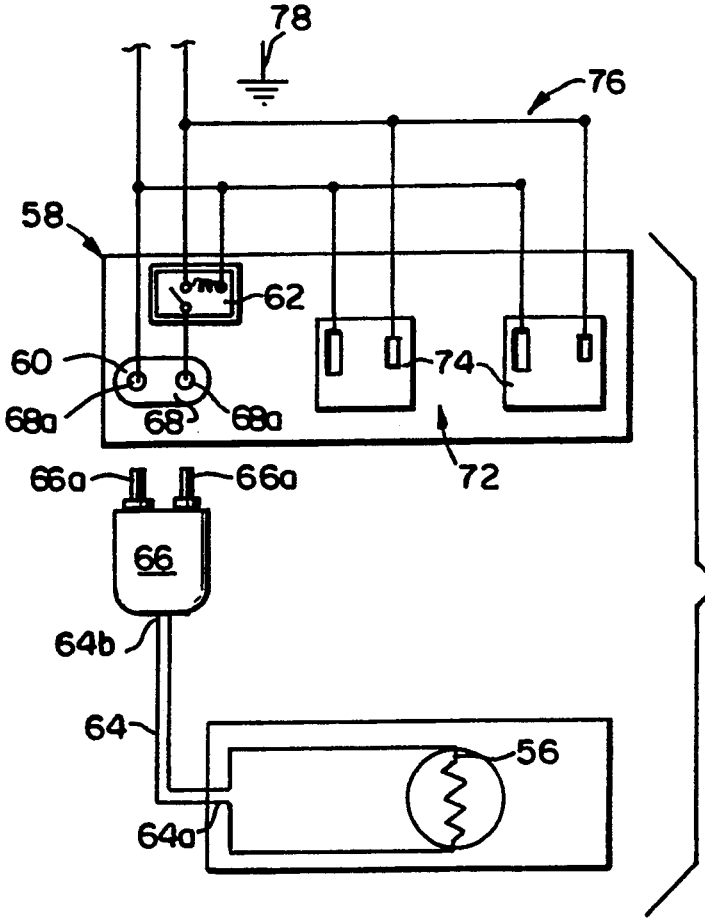
FIG. 5

CABINET HAVING AN INTERNAL POWER SUPPLY AND A DOOR CASING GASKET

This is a continuation application of Ser. No. 07/889,658, filed May 27, 1992, now abandoned, which this is a division of application of Ser. No. 07/587,701, filed Sep. 25, 1990, now abandoned.

FIELD OF THE INVENTION

The present invention relates to a cabinet and, more particularly, to a cabinet having an internal power supply and gasket on the door casing for receiving a heated cabinet door with a finger grip.

BACKGROUND OF THE INVENTION

Conventional cabinets include a cabinet body which has an internal storage area for receiving items to be stored and a door casing defining an opening for accessing the storage area. The cabinet body is typically comprised of a pair of spaced apart vertically extending side walls interconnected with upper and lower spaced apart horizontal walls. The walls of the cabinet body include a generally planar flange for receiving the interior surface of a cabinet door when the cabinet door is in the closed position. Typically, the flanges of the vertical walls are in an abutting relationship with the flanges of the horizontal walls. More particularly, the abutting portions of the flanges are generally mitered at a 45° angle so that the abutting flanges complement each other in an aesthetically pleasing abutting relationship.

While the mitered edges of the wall flanges provide an aesthetically pleasing door casing as compared to abutting the flanges in a horizontal or vertical manner, mitered flanges are problematic in that they are expensive to manufacture. Mitering the flanges requires an extensive amount of manufacturing time to ensure that the flanges abut without an unsightly gap therebetween. Hence, there is a need in the cabinet field for a cabinet body wherein the walls thereof are not mitered and yet the cabinet still provides an aesthetically pleasing door casing.

In other conventional cabinets, the periphery of the cabinet body and cabinet door are aligned with and complement each other so that the door precisely covers the edges of the cabinet. While this provides the closed cabinet with a clean outer appearance, the cabinet door is often hard to open because knobs or other such devices are not generally used and it is difficult for the user to grip the finished edge of the door.

Therefore, a need exists for a cabinet with a finger grip which extends along the interior surface and edge of the cabinet door between the cabinet door and door casing to afford a convenient gripping means which does not affect the appearance of the cabinet door and still allows the periphery of the cabinet door and cabinet body to complement each other.

Other conventional cabinets include mirrored doors which are hingedly mounted to the cabinet body. Such cabinets are typically mounted in bathrooms where steam or fog flows from a shower or bath. Consequently, condensation usually forms on the exterior surface of the cabinet door to prevent the mirror from being used. The incorporation of a heating element within or on the cabinet door to prevent condensation from forming on the exterior surface thereof is one attempt to solve this problem. Typically, the heating element is hard wired to a power supply. In the event that the cabinet door or heating element need to be replaced or repaired, the cabinet must be removed from the mounting wall in order to access the power supply. Hence, there is a need for a cabinet having a cabinet door with a heating element wherein the cabinet door can be easily removed for repair or replacement without having to completely dismantle or remove the cabinet.

As mentioned above, typical cabinets include a cabinet body having an internal storage area for receiving items to be stored. Such items are typically non-electrical items, such as prescription drugs, toothpaste and other cosmetic or personal care items. However, rechargeable appliances, such as curling irons and electric razors are also often found or used in bathrooms. In order to recharge the rechargeable appliance, it is necessary to plug the recharger for the appliance in an exposed electrical outlet in a wall or light fixture outside of the cabinet. As such, the recharging appliance is displayed for view by anyone entering the room.

A need exists for a cabinet wherein the internal storage area is equipped with a power supply for electrically receiving a rechargeable appliance so that the rechargeable appliance can be positioned within the storage area for recharging out of view.

The present invention overcomes many of the disadvantages inherent in the above-described cabinets by providing a cabinet having a cabinet body with an internal storage area and a gasket positioned on a door casing defining an opening for accessing the storage area. The gasket permits the use of less expensive butt-type (non-mitered) cabinet wall joints. The cabinet of the present invention includes a finger grip secured to the cabinet door proximate the peripheral edge for assisting in moving the cabinet door between an open and closed position. The cabinet of the present invention also includes a power supply positioned within the internal storage area of the cabinet body for releasably receiving an electrical conductor of a heating element mounted on the cabinet door and an electrical conductor of a rechargeable appliance.

SUMMARY OF THE INVENTION

Briefly stated, the present invention comprises a cabinet comprising a cabinet body having an internal storage area for receiving items to be stored and a door casing which defines an opening for accessing the storage area. The cabinet door is pivotally mounted to the cabinet body and includes an interior surface and an exterior surface. A hinge means is interconnected between the cabinet door and the cabinet body for allowing the cabinet door to pivot with respect to the cabinet body between a first position wherein the cabinet door is positioned proximate the door casing and a second position wherein the cabinet door is positioned away from the door casing. A gasket is positioned on the door casing such that the gasket substantially covers the door casing. As such, the interior surface of the cabinet door is in engagement with the gasket when the cabinet door is in the first position.

BRIEF DESCRIPTION OF THE DRAWINGS

The foregoing summary, as well as the following detailed description of preferred embodiments, will be better understood when read in conjunction with the appended drawings. For the purpose of illustrating the invention, there is shown in the drawings embodiments which are presently preferred, it being understood, however, that the invention is not limited to the specific methods and instrumentalities disclosed. In the drawings:

FIG. 4 is an enlarged cross-sectional view of an electrical outlet shelf within the cabinet taken along line 4—4 of FIG. 1;

FIG. 5 is a partial schematic view of the electrical outlet shelf and cabinet door heating element in accordance with the present invention

DESCRIPTION OF PREFERRED EMBODIMENT

Figure 1:
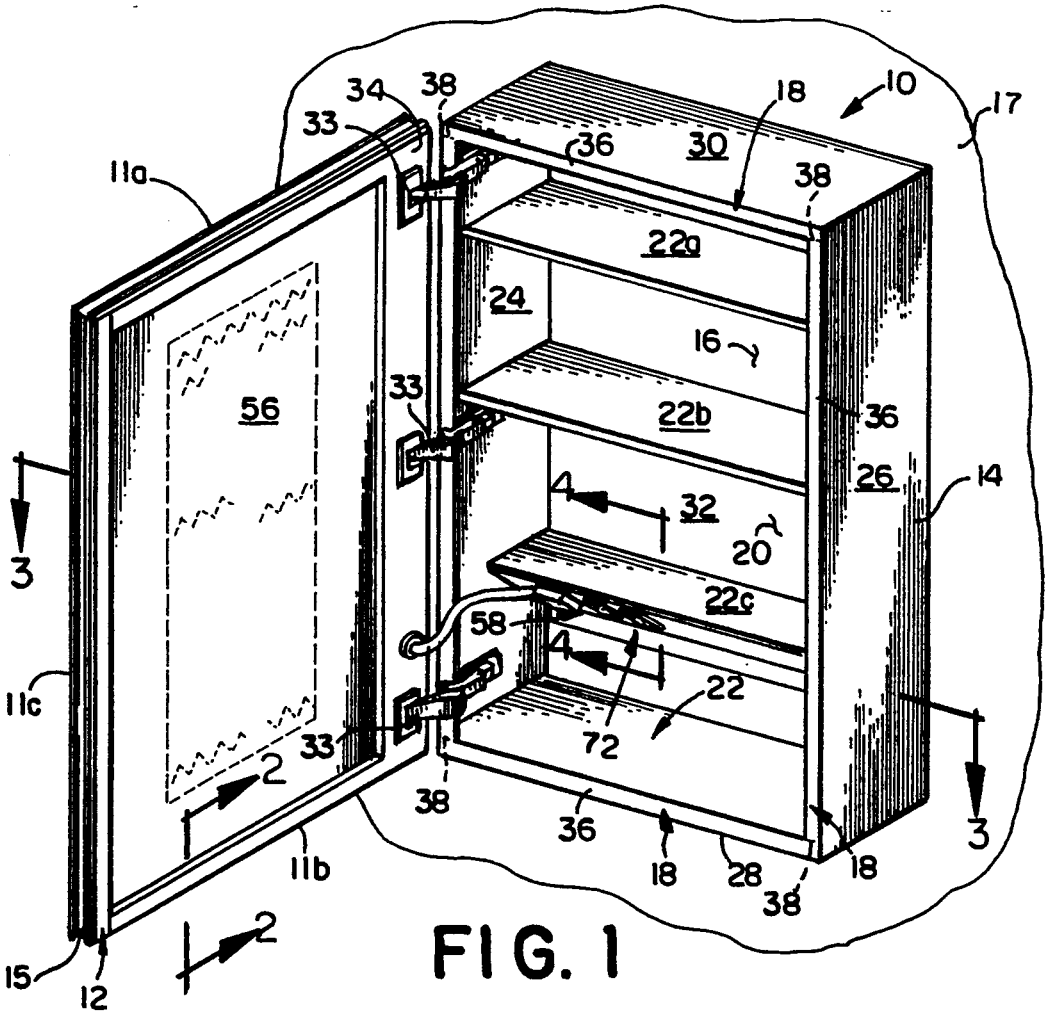
FIG. 1 is a perspective view of a cabinet in accordance with the present invention.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the cabinet, and designated parts thereof. The terminology includes the words above specifically mentioned, derivatives thereof and words of similar import.

Referring now to the drawings in detail, wherein like numerals indicate like elements throughout, there is shown in FIGS. 1-6, a preferred embodiment of a cabinet in accordance with the present invention.

FIG. 1 perspectively illustrates a cabinet 10 having a cabinet door 12. The cabinet 10 encloses a cabinet body 14 having an internal storage area 16 for receiving items (not shown) to be stored. The cabinet body 14 further includes a door casing 18 defining an opening 20 for accessing the storage area 16. An upper shelf 22*a*, middle shelf 22*b*, and lower shelf 22*c* are positioned within the storage area 16 of the cabinet body 14 for receiving the items to be stored.

Figure 2:
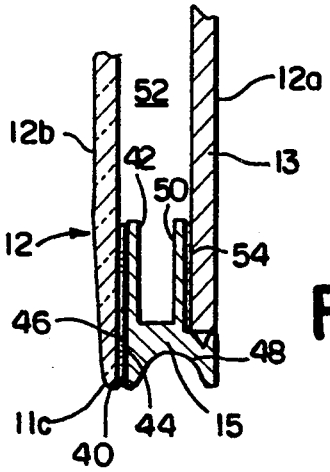
FIG. 2 is an enlarged cross-sectional view of a portion of the cabinet door taken along line 2—2 of FIG. 1.
Figure 6:
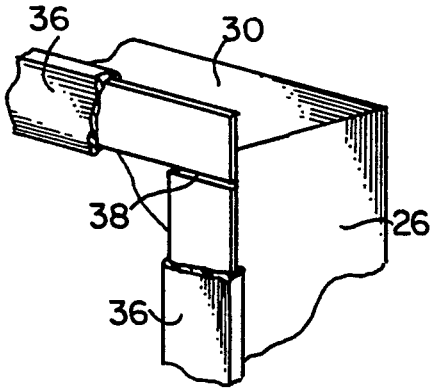
FIG. 6 is an enlarged perspective view, partially broken away, of a portion of a preferred embodiment of the wall mounted cabinet body of the present invention.
Figure 3:
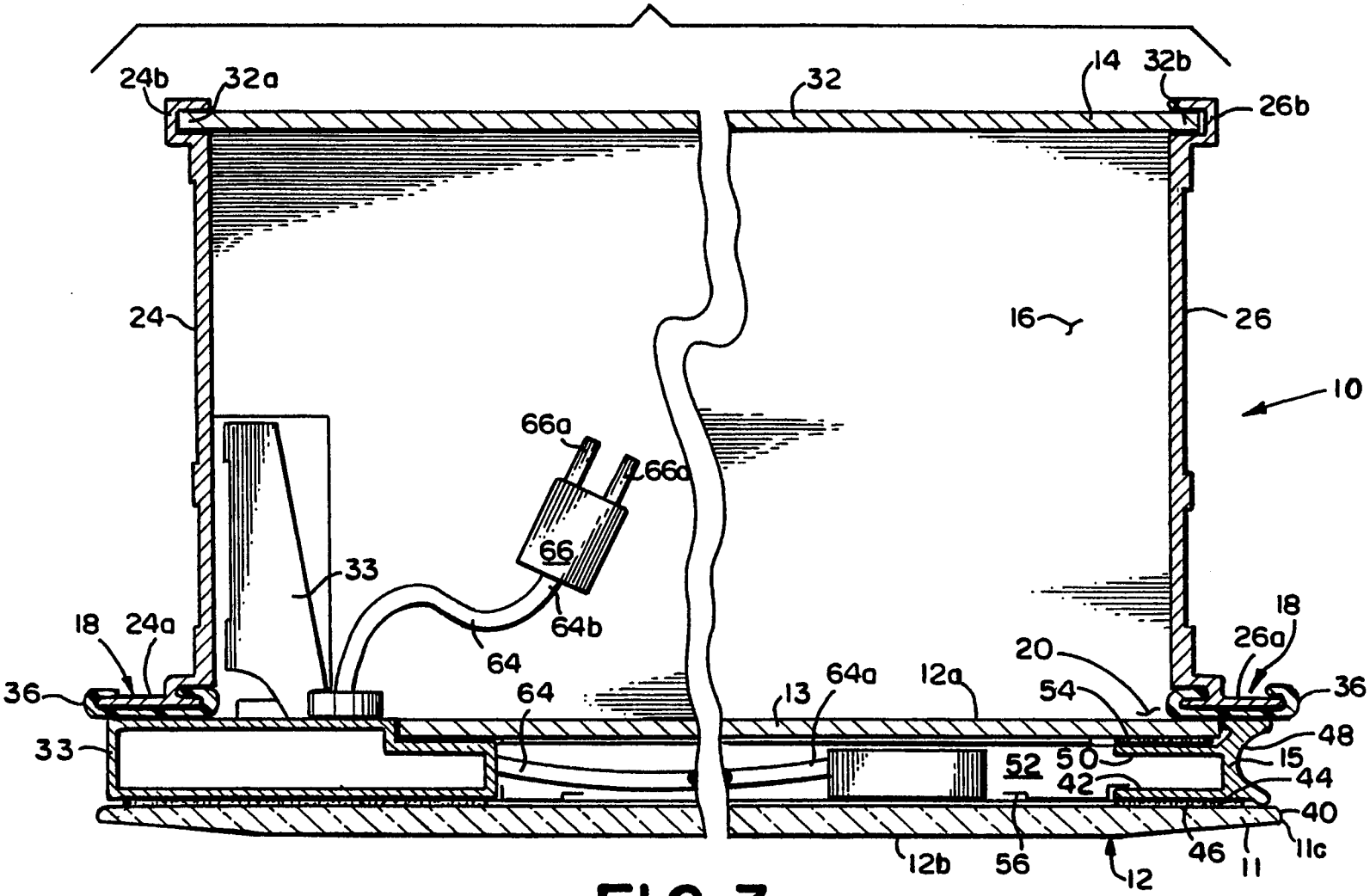
FIG. 3 is an enlarged cross-sectional view of the cabinet taken along line 3—3 of FIG. 1 showing the cabinet door in a closed position.

Referring now to FIGS. 2 and 3, the cabinet door 12 is pivotally mounted to the cabinet body 18 and includes an interior surface 12*a* and an exterior surface 12*b*. In the present embodiment, it is preferred that the exterior surface 12*b* be a reflective exterior surface such as a mirror. It is also preferred that the cabinet door 12 and the interior surface 12*a* be generally planar.

In the present embodiment, the cabinet door 12 is preferably comprised of an exterior panel 11 and an interior panel 13 with a finger grip 15 disposed therebetween, as described in more detail hereinafter. However, it is understood by those skilled in the art, that the present invention is not limited to any particular door structure. For instance, the cabinet door 12 can be of single piece construction with a hollowed out portion for receiving a heating element 56, as described in more detail below, without departing from the spirit and scope of the invention.

Referring now to FIGS. 1 and 3, the cabinet body 14 preferably comprises a pair of respective side walls 24, 26, a bottom wall 28, a top wall 30 and a rear wall 32. In the present embodiment, it is preferred that the side walls 24, 26, bottom wall 28 and top wall 30 be constructed of a lightweight high strength metallic material, such as aluminum. More particularly, it is preferred that the side walls 24, 26 and bottom and top walls 28, 30, respectively, be extruded in the same general configuration. However, it is understood by those skilled in the art, that other processes and materials can be used to construct the various walls and that the walls can be of different shapes without departing from the spirit and scope of the invention. For instance, the walls 24, 26, 28 and 30 could be constructed of a cast metallic material or wood.

In the present embodiment, it is preferred that the rear wall 32 be constructed of a natural material, such as wood. For instance, the rear wall 32 could be constructed of a thin plywood (e.g., luaun) or other like material. However, it is understood by those skilled in the art, that the rear wall 32 could be mirrored or constructed of other materials, such as a metallic or polymeric material.

As shown in FIG. 3, the side walls 24, 26 are preferably provided with generally vertically oriented planar flanges 24*a*, 26*a*, respectively. The flanges 24*a*, 26*a* extend generally parallel to the interior surface 12*a* of the cabinet door 12 when the cabinet door is in the closed position (as shown in FIG. 3). The side walls 24, 26 further include respective open-mouthed channels 24*b*, 26*b* which face each other and are oriented to engage respective vertical edges 32*a*, 32*b* of the rear wall 32.

The bottom and top walls 28, 30 also include open-mouthed channels (not shown) for receiving the horizontal edges of the rear wall 32. Additionally, the bottom and top walls 28, 30 also include, respectively, generally vertically oriented planar flanges which are generally identical to the flanges 24*a*, 26*a* of the side walls 24, 26.

In the present embodiment, the bottom and top walls 28, 30 are preferably secured to the side walls 24, 26 by means of conventional fasteners (not shown), such as screws. However, it is understood by those skilled in the art, that the cabinet body 14 and its respective walls can be secured together through other means, such as by welding or by an adhesive or some combination thereof.

As shown in FIGS. 1 and 3, hinge means are interconnected between the cabinet door 12 and the cabinet body 14 for allowing the cabinet door 12 to pivot with respect to the cabinet body 14 between a first position (shown in FIG. 3) wherein the cabinet door 12 is closed or positioned proximate the door casing 18 and a second position (shown in FIG. 1) wherein the cabinet door 12 is open or positioned away from the door casing 18, as is understood by those skilled in the art.

In the present embodiment, it is preferred that the hinge means be comprised of three standard hinges 33 generally spaced along and interconnected between a proximal edge 34 of the cabinet door 12 and the interior surface of the side wall 24 of the cabinet body 14. However, it is understood by those skilled in the art, that the hinge means could be comprised of a longitudinally extending cabinet hinge (not shown) positioned along and interconnected between the proximal edge 34 of the cabinet door 12 and the cabinet body 14.

It is understood by those skilled in the art, that the present invention is not limited to any specific type, shape or size cabinet and that the cabinet 10 can be surface or recess mounted. That is, the general overall configuration of the cabinet 10 is of the type which is known to those skilled in the art and, therefore, further description thereof is omitted for convenience only, and is not limiting. However, it is preferred that the present invention be used in conjunction with a bath-type cabinet wherein the exterior surface 12*b* of the cabinet door 12 is a mirror.

Referring now to FIG. 3, a gasket 36 is positioned on the door casing 18 such that the gasket 36 substantially covers the door casing 18 whereby the interior surface 12*a* of the cabinet door 12 is in engagement with the gasket 36 when the cabinet door 12 is in the first or closed position. More particularly, it is preferred that the gasket 36 substantially cover and surround the flanges 24*a*, 26*a* of the side walls 24, 26, as well as the flanges (not shown) of the bottom and top walls 28, 30. The flanges of the side, bottom and top walls 24, 26, 28, 30 are preferably in abutting relationship, such that a line of separation 38 is defined therebetween as best seen in enlarged view 6. The gasket 36 is positioned on the flanges such that the gasket 36 surrounds the flanges and the line of separation 38 is substantially covered.

In the present embodiment, it is preferred that the lines of separation 38 extend generally parallel to the top wall 30, as shown in FIG. 1. As such, when the cabinet body 14 is assembled, it is not necessary to miter the flanges of the side, top or bottom wall walls 24, 26, 28, 30, since they are substantially covered by the gasket 36. It is understood by those skilled in the art, that the present invention is not limited to any particular orientation of the lines of separation 38, which could extend generally perpendicularly with respect to the top wall 30.

It is preferred that the gasket 36 be formed in a single piece by a molding process such that the gasket 36 clips or snaps onto the flanges of the side, bottom and top walls 24, 26, 28, 30 of the cabinet body 14. However, it is understood by those skilled in the art, that other means can be used to secure the gasket 36 to the flanges, such as an adhesive, and that other methods can be used to manufacture the gasket 36.

In the present embodiment, it is preferred that the gasket 36 be constructed of a generally pliable polymeric material, such as polyvinylchloride to permit gasket 36 to clip or snap onto flanges 24*a* and 26*a* as required to secure gasket 36 to flanges 24*a* and 26*a*. However, it is understood by those skilled in the art, that other materials can be used to construct the gasket, such as neoprene, polyethylene or rubber (e.g., buna N). By forming the gasket 36 of a pliable material, a dampening effect is provided when the door is placed in the closed position. In addition, the pliable gasket 36 compensates for irregularities in the contacting door surface.

Referring now to FIGS. 2 and 3, the finger grip 15 is secured to the cabinet door 12 proximate its peripheral edge 40 for assisting in moving the cabinet door 12 between the first and second positions. In the present embodiment, it is preferred that the peripheral edge 40 of the cabinet door 12 complement the door casing 18 such that the cabinet body 14 is out of view when the cabinet door 12 is in the closed or first position when viewed from the front. However, it is understood by those skilled in the art, that the peripheral edge 40 of the cabinet door 12 could deviate from the outline of the cabinet body 14 without departing from the spirit and scope of the invention.

Referring now to FIGS. 2 and 3, it is preferred that the finger grip 15 be adhesively secured to the cabinet door 12. More particularly, the finger grip 15 preferably includes a generally planar mounting element 42 having a mounting surface 44 adhesively secured to the exterior panel 11 of the cabinet door 12. In the present embodiment, it is preferred that the mounting surface 44 be adhesively secured to the exterior panel 11 by double sided tape 46, as is understood by those skilled in the art. It is also understood by those skilled in the art, that other adhesives can be used to secure the mounting surface 44 to the exterior panel 11, such as epoxy. While it is preferred that the finger grip 15 be adhesively secured to the cabinet door 12, it is understood by those skilled in the art, that other fastening devices can be used, such as standard hardware or the like (e.g., screws).

The finger grip 15 preferably further includes an arcuate surface 48 for receiving a finger (not shown) of a user to move the cabinet door 12 between the first and second positions. As shown in FIG. 2, it is preferred that the arcuate surface be generally semi-circular in cross section. However, it is understood by those skilled in the art, that the arcuate surface 48 could be of other cross-sectional configurations. For instance, the arcuate surface 48 could be generally V-shaped in cross-section.

In the present embodiment, it is preferred that the finger grip 15 further include a shoulder portion 50 spaced from the mounting element 42 and the exterior panel 11 for receiving the interior panel 13 such that a space 52 exists between the exterior panel 11 and the interior panel 13. The interior panel 13 preferably complements the finger grip 15 and/or the periphery of the exterior panel 11 such that the space 52 between the exterior panel 11 and the interior panel 13 is not within view when the cabinet door 12 is in the open position. In the present embodiment, it is preferred that the interior panel 13 be adhesively secured to the shoulder portion 50 by double sided tape 54, as described above in connection with the exterior panel 11. In the present embodiment, it is preferred that the interior surface 12*a* of the interior panel 13 be a reflective surface such as a mirror.

In the present embodiment, the finger grip 15 is preferably constructed of an extruded lightweight high strength metallic material, such as aluminum. However, it is understood by those skilled in the art, that other processes and materials can be used to fabricate the finger grip 15. For instance, the finger grip 15 could be constructed of a cast metallic material or wood.

As shown in FIG. 1, it is preferred that the finger grip 15 extend completely along the upper and lower edges 11*a*, 11*b*, respectively, and the side edge 11*c* of the exterior panel 11 to allow the user to grip the door 12 anywhere along its periphery (other than along the hinge side). However, it is understood by those skilled in the art, that the finger grip 15 or at least the arcuate surface 48 may extend along only a portion of the periphery without departing from the spirit and scope of the invention. For instance, the finger grip 15 could extend only along the lower edge 11*b* of the exterior panel 11.

Referring now to FIGS. 1, 3 and 5, the cabinet door 12 preferably includes a heating element 56 for heating the cabinet door 12 to prevent condensation from forming on the exterior surface 12*b* thereof. In the present embodiment, it is preferred that the heating element 56 be a generally flat resistance type heating element adhesively applied to the exterior panel 11 on the surface thereof within the space 52. The heating element 56 is of the type which is well known to those skilled in the art, accordingly further description thereof is omitted for convenience only and is not limiting.

Referring now to FIGS. 1, 4 and 5, a power supply, generally designated 58, is positioned within the internal storage area 16 of the cabinet body 14. In the present embodiment, it is preferred that the power supply 58 include an electrical outlet 60 positioned on the lower shelf 22*c* of the cabinet body 14, as described in more detail hereinafter. As schematically shown in FIG. 5, it is further preferred that a switch 62 be in electrical communication with the electrical outlet 60. The switch 62 has a first position (not shown) wherein power is supplied to the electrical outlet 60 and a second position (as shown in FIG. 5) where power is not supplied to the electrical outlet 60.

As shown in FIGS. 1, 3 and 5, an electrical conductor 64 having a first end 64*a* and a second end 64*b* is in electrical communication with the heating element 56. That is, the first end 64*a* of the electrical conductor 64 is in electrical communication with the heating element 56. The second end 64*b* of the electrical conductor 64 is in releasable electrical communication with the power supply 58 such that the power supply 58 provides electrical current to the heating element 56. More particularly, it is preferred that the second end 64*b* of the electrical conductor 64 be in electrical communication with an electrically conductive connector component 66 releasably positioned within a mating connector component 68 of the electrical outlet 60.

It is preferred that the electrically conductive connector component 66 and mating connector component 68 include a standard male-female connection. That is, the electrically conductive connector component 66 preferably includes a pair of electrically conductive prongs 66*a*. Similarly, it is preferred that the mating connector component 68 include a pair of electrically conductive apertures 68*a* for receiving the prongs 66*a*, as is understood by those skilled in the art. It is similarly understood by those skilled in the art, that other quick connector components can be used without departing from the spirit and scope of the invention.

Referring now to FIGS. 1 and 4, the lower shelf 22*c* positioned within the internal storage area 16 of the cabinet body 14 is for receiving a rechargeable appliance (not shown). In the present embodiment, the lower shelf 22*c* includes the power supply 58 for the heating element 56 and a power supply 72 for being in electrical communication with the rechargeable appliance such that a rechargeable appliance can be positioned and recharged within the internal storage area 16. It is preferred that the power supply 72 be comprised of at least two standard electrical outlets 74. However, it is understood by those skilled in the art, that any number of electrical outlets 74 (including one) can be positioned on the lower shelf 22*c* for charging a plurality of rechargeable appliances, without departing from the spirit and scope of the invention.

In the present embodiment, it is preferred that the power supply 58 for the heating element 56 and the power supply 72 for the rechargeable appliance be a single circuit 76 positioned on the shelf 22*c* having a ground 78. It is preferred that the single circuit 76 be directly hardwired to an external power source (not shown) provided at the site of installation.

In the single circuit 76, the electrical outlet 60 and switch 62 for the heating element 56 are preferably connected in series to the external power supply provided at the site of installation to permit switch actuated control of the heating element 56. Similarly, it is preferred that the electrical outlets 74 of the power supply 72 be connected in parallel to electrical outlet 60 and switch 62. However, it is understood by those skilled in the art, that the electrical outlets 60, 74 and the switch 62 can be electrically interconnected in any manner. For instance, both the power supply 58 for the heating element 56 and the power supply 72 for the electrical outlet 74 could be separately hardwired to an external power supply (not shown) provided at the installation site.

Referring now to FIG. 4, the lower shelf 22*c* is preferably comprised of a mounting bracket 80 secured to the rear wall 32. More particularly, the mounting bracket 80 includes a pair of open mouthed channels 82 for receiving edges 84 of the rear wall 32, as described above in connection with the side walls 24, 26. The mounting bracket preferably includes an aperture 86 for receiving conductive elements (i.e., wires) from the external power supply provided at the site of installation.

Interconnected to the mounting bracket 80 is a support member 88. The support member 88 is generally V-shaped in cross section. The support member 88 extends from the rear wall 32 toward the cabinet door 12 a distance which is less than the width of the side wall 24 for allowing the electrical cord of a recharger (not shown) to pass between the support member 88 and the cabinet door 12 when a rechargeable appliance is positioned thereon and the door 12 is in the closed position. This allows the cabinet door 12 to be closed when the rechargeable appliance is located on the lower shelf 22*c*.

The support member 88 is preferably comprised of a first leg 88*a* and a second leg 88*b*. The first leg 88*a* preferably extends generally horizontally for receiving and supporting the rechargeable appliance and includes a fastening element 90 at a distal end thereof extending along the entire length of the lower shelf 22*c*. The fastening element 90 preferably fits within a complementary slot 92 of the mounting bracket 80 for securing the support member 88 to the mounting bracket 80.

The second leg 88*b* of the support member 88 preferably extends generally diagonally from the first leg 88*a* toward the other end of the mounting bracket 80. The second leg 88*b* preferably securely receives the power supplies 58, 72. By locating the power supplies 58, 72 on the second leg 88*b* room is provided for the connector component 66 or other connector components of a recharger when the cabinet door 12 is closed.

As shown in FIG. 4, a standard fastener, such as a screw 94 interconnects the second leg 88*b* of the support member 88 to the mounting bracket 80. To assemble the lower shelf 22*c*, the cabinet 10 is first surface or recess mounted to a wall (not shown) with the wires (not shown) from an external power source positioned through the aperture 86 of the mounting bracket 80. The wires are then electrically connected to the power supplies 58, 72. The fastening element 90 is then positioned within the slot 92 and the support member 88 is pivoted downwardly such that the second leg 88*b* engages the mounting bracket 80. The screw 94 is then fastened to the second leg 88*b* and the mounting bracket 80 to complete the assembly of the lower shelf 22*c*.

While it is preferred that the power supplies 58, 72 be installed on the lower shelf 22*c*, it is understood by those skilled in the art, that the power supplies 58, 72 could be mounted anywhere within the internal storage area 16. For instance, the power supplies 58, 72 could be installed on the middle or lower shelves 22*b*, 22*a* or on one of the side walls 24, 26 without departing from the spirit and scope of the invention.

Referring now to FIGS. 1 and 3, in use the cabinet 10 is surface or recess mounted to a wall 17 and is hard-wired to the power source at the installation site. The gasket 36 provides the cabinet body 14 with an aesthetically pleasing door casing 18 without having to miter the flanges of the side walls 24, 26, bottom wall 28 or top wall 30. The connector component 66 is placed in electrical communication with the mating connector component 68 of the electrical outlet 60 to place the heating element 56 in a ready to operate condition. When it is expected that condensation will form on the exterior surface 12*b* of the cabinet door 12 (e.g., when the shower is in use), the switch 62 is moved from the second position to the first position to supply power from the electrical outlet 68 to the heating element 56 to heat the exterior panel 11 and prevent condensation from forming on the exterior surface 12*b* of the cabinet door 12.

In the event that the door 12 or heating element 56 needs repair, the door 12 is easily removed from the cabinet body 14 by simply removing the hinges 33 and disconnecting the connector component 66. Thus, repairs can be effected without the necessity of removing the entire cabinet 10 from the installation site.

Rechargeable appliances (not shown) may be stored during charging within the internal storage area 16 of the cabinet 14 with the door closed by positioning the same on the lower shelf 22*c* and placing the rechargeable appliance in electrical communication with the power supply 72, as is understood by those skilled in the art.

From the foregoing description, it can be seen that the present invention comprises a cabinet having an internal power supply and a gasket on the door casing for receiving a heated cabinet door with a finger grip. It will be recognized by those skilled in the art, that changes may be made to the above-described embodiments of the invention without departing from the broad inventive concept thereof. It is understood, therefore, that this invention is not limited to the particular embodiments disclosed, but is intended to cover all modifications which are within the spirit and scope of the invention as defined by the appended claims.

I claim:

1. A wall mounted cabinet comprising:

a cabinet body mounted on a wall and having an internal storage area for receiving items to be stored and a door casing defining an opening for accessing said storage area;

a cabinet door pivotally mounted to said cabinet body, said cabinet door having an interior surface and an exterior surface;

hinge means interconnected between said cabinet door and said cabinet body for allowing said cabinet door to pivot with respect to said cabinet body between a first position wherein said cabinet door is positioned proximate said door casing and a second position wherein said cabinet door is positioned away from said door casing;

a gasket positioned on said door casing such that said gasket substantially covers said door casing whereby said interior surface of said cabinet door is positioned against said gasket when said cabinet door is in said first position; and said door casing comprising a corner formed of generally planar flanges extending generally parallel to said interior surface of said cabinet door when said cabinet door is in said first position, said flanges each including a generally orthogonal end in elevational view, said ends of said flanges being in a non-mitered abutting relationship such that a line of separation is defined therebetween, said gasket being positioned on said flanges such that said gasket surrounds the flanges and said line of separation is substantially covered.

2. The cabinet as recited in claim 1, wherein said gasket is constructed of a polymeric material.

3. The cabinet as recited in claim 2, wherein said polymeric material is polyvinylchloride.

* * * * *